US008512049B1

(12) United States Patent
Huber et al.

(10) Patent No.: US 8,512,049 B1
(45) Date of Patent: Aug. 20, 2013

(54) SOLDERLESS COMPRESSION CONNECTOR COMPRISING CONSTANT WIDTH CONDUCTING ELEMENTS HOUSED SUBSTANTIALLY WITHIN A DIELECTRIC WHEN INSTALLED

(75) Inventors: William D. Huber, Hollister, CA (US); Jon E. Jacoby, San Jose, CA (US)

(73) Assignee: Western Digital Technologies, Inc., Irvine, CA (US)

( * ) Notice: Subject to any disclaimer, the term of this patent is extended or adjusted under 35 U.S.C. 154(b) by 198 days.

(21) Appl. No.: 13/071,722

(22) Filed: Mar. 25, 2011

(51) Int. Cl.
*H01R 12/00* (2006.01)

(52) U.S. Cl.
USPC ..... 439/66

(58) Field of Classification Search
USPC ..... 439/66, 71, 591
See application file for complete search history.

(56) References Cited

U.S. PATENT DOCUMENTS

| | | | | |
|---|---|---|---|---|
| 4,891,019 | A | 1/1990 | Olsson | |
| 5,454,157 | A * | 10/1995 | Ananth et al. | 29/603.03 |
| 5,464,355 | A * | 11/1995 | Rothenberger | 439/559 |
| 5,484,295 | A | 1/1996 | Mowry et al. | |
| 5,498,166 | A * | 3/1996 | Rothenberger | 439/66 |
| 5,966,267 | A * | 10/1999 | Hooley et al. | 360/99.16 |
| 6,027,381 | A | 2/2000 | Lok | |
| 6,033,253 | A | 3/2000 | Yi et al. | |
| 6,135,782 | A | 10/2000 | Cox et al. | |
| 6,176,707 | B1 * | 1/2001 | Neidich et al. | 439/66 |
| 6,217,342 | B1 * | 4/2001 | Neidich et al. | 439/66 |
| 6,358,063 | B1 * | 3/2002 | Neidich | 439/66 |
| 6,485,338 | B1 | 11/2002 | Wu | |
| 6,625,881 | B2 | 9/2003 | Ammar et al. | |
| 6,764,315 | B2 | 7/2004 | Ng et al. | |
| 6,863,540 | B2 | 3/2005 | Spykerman | |
| 7,147,477 | B2 | 12/2006 | Soh | |
| 7,690,923 | B2 | 4/2010 | Horchler et al. | |
| 7,708,608 | B2 | 5/2010 | Soh | |
| 2003/0224662 | A1 | 12/2003 | Parson et al. | |
| 2009/0239396 | A1 | 9/2009 | Tay et al. | |
| 2009/0269949 | A1 | 10/2009 | Schmidgall et al. | |

OTHER PUBLICATIONS

Amphenol Intercon Systems Inc., "cLGA 88 Position .050 C/L Connector", Harrisburg, PA 17110, pdf Spec Sheet.
Amphenol Intercon Systems Inc., "L108 LGA Electrical Performance", May 7, 2009, Harrisburg, PA 17110, pdf Spec Sheet.

* cited by examiner

*Primary Examiner* — Xuong Chung Trans

(57) ABSTRACT

A solderless compression connector is disclosed operable to couple first and second electrical components. The solderless compression connector comprises a housing comprising a dielectric forming a plurality of chambers, and an elongated conducting element disposed in each chamber. Each elongated conducting element comprises a first end operable to engage a first electrical lead of the first electrical component, and a second end operable to engage a second electrical lead of the second electrical component. Each elongated conducting element comprises a substantially constant thickness, and each elongated conducting element comprises a substantially constant width along a length of the elongated conducting element. A spacing between at least two of the elongated conducting elements is substantially constant. After installing the solderless compression connector, the elongated conducting elements are housed substantially within the respective chambers.

21 Claims, 5 Drawing Sheets

SOLDERLESS COMPRESSION CONNECTOR COMPRISING CONSTANT WIDTH CONDUCTING ELEMENTS HOUSED SUBSTANTIALLY WITHIN A DIELECTRIC WHEN INSTALLED

BACKGROUND

Compression connectors are typically used to couple signal paths of two electrical components, such as coupling two printed circuit boards (PCBs) or coupling a flex circuit to a PCB. The compression connector may comprise a number of elongated conducting elements where each end forms a conducting surface for coupling to respective electrical interfaces (e.g., traces) of the electrical component. Each elongated conducting element typically forms a spring which compresses when coupling the electrical components. For example, a first end of the elongated coupling element may be soldered to the electrical interface of a first electrical component, whereas a second end of the elongated conducting element may simply be compressed against the electrical interface of a second electrical component. The connector is then held in the compressed state using any suitable fastener, such as a screw.

DETAILED DESCRIPTION OF EMBODIMENTS OF THE INVENTION

Figure 1A:
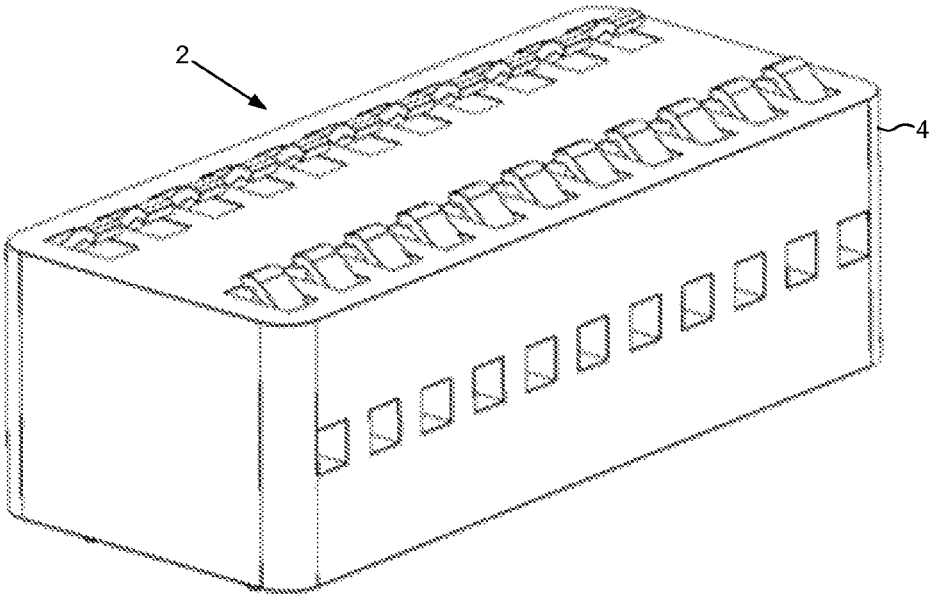
FIGS. 1A and 1B show perspective views of a solderless compression connector according to an embodiment of the present invention.
Figure 1B:
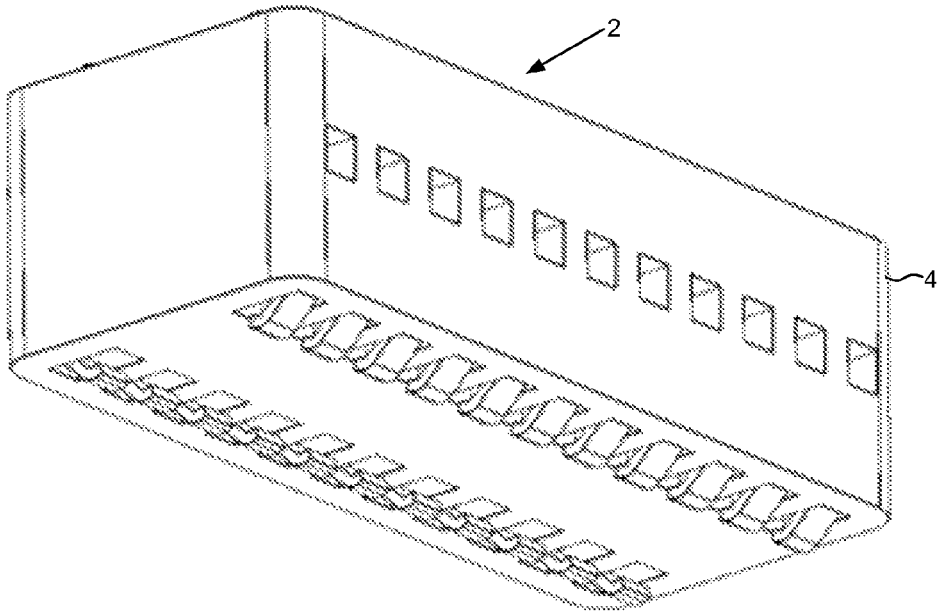

FIGS. 1A and 1B show perspective views of a solderless compression connector 2 operable to couple first and second electrical components. The solderless compression connector 2 comprises a housing 4 comprising a dielectric forming a plurality of chambers (e.g., 6A-6D of FIG. 2), and an elongated conducting element disposed in each chamber (e.g., 8A-8D if FIG. 2). Each elongated conducting element comprises a first end operable to engage a first electrical lead of the first electrical component, and a second end operable to engage a second electrical lead of the second electrical component. Each elongated conducting element comprises a substantially constant thickness, and each elongated conducting element comprises a substantially constant width along a length of the elongated conducting element. A spacing between at least two of the elongated conducting elements is substantially constant. After installing the solderless compression connector 2, the elongated conducting elements are housed substantially within the respective chambers.

Figure 2:
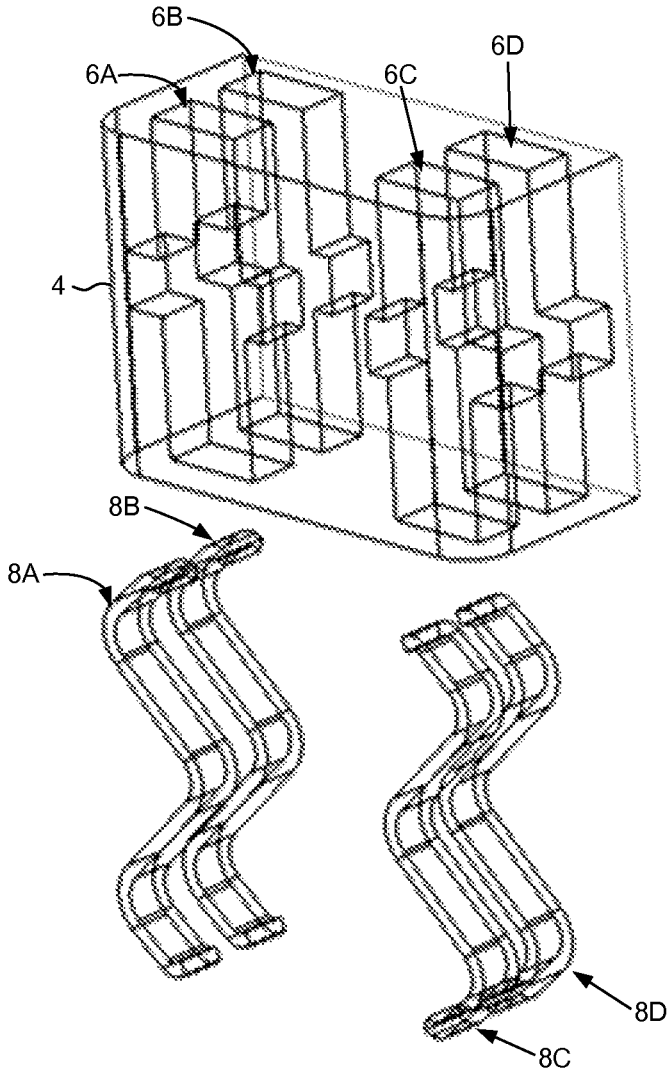
FIG. 2 shows an exploded, perspective view of a section of the solderless compression connector shown in FIG. 1A according to an embodiment of the present invention.
Figure 4A:
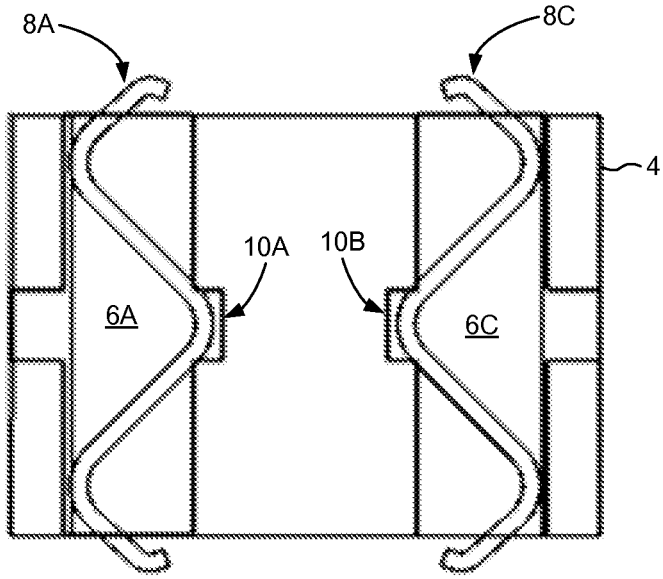
FIG. 4A shows a cross sectional view of the solderless compression connector shown in FIG. 1A before being installed according to an embodiment of the present invention.
Figure 4B:
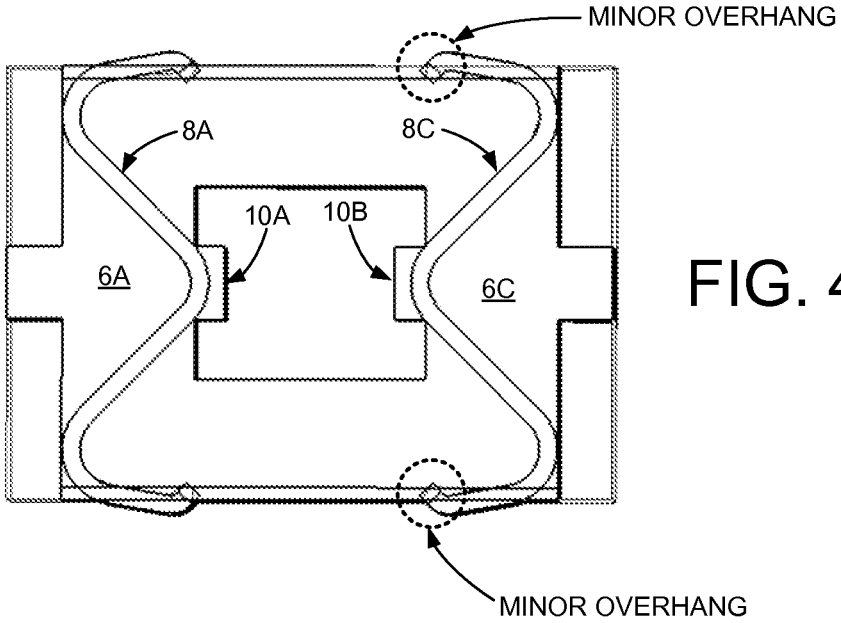
FIG. 4B shows a cross sectional view of the solderless compression connector shown in FIG. 1A after being installed according to an embodiment of the present invention.

The housing 4 may comprise any suitable dielectric, such as any suitable plastic, and the elongated conducting elements may comprise any suitable conductor, such as any suitable metal (e.g., steel, copper, aluminum, etc.). In one embodiment, at least one pair of the elongated conducting elements (e.g., 8A and 8B of FIG. 2) form part of transmission lines carrying a differential signal. For example in an embodiment shown in FIG. 5, at least one pair of the elongated conducting elements form transmission lines that couple a flex circuit inside an HDA to a PCB mounted to the HDA. The flex circuit comprises the transmission lines that couple the interface circuitry mounted to the PCB to the head inside the HDA (e.g., write or read signals). It is typically desirable to achieve a controlled impedance (e.g., a uniform impedance) along the entire length of a transmission line, including through the conducting elements in a coupling connector. In the embodiment of FIG. 2, various features help control impedance, such as each elongated conducting element comprising a substantially constant thickness and a substantially constant width along a length of the elongated conducting element, as well as a substantially constant spacing between at least two of the elongated conducting elements. Another significant feature that helps control the impedance is for the elongated conducting elements to be substantially housed within the respective chambers after installing the solderless compression connector (as illustrated in FIG. 4B). In this manner, each elongated conducting element is substantially surrounded and affected by the permeability of the dielectric of the housing 4 rather than the permeability of air if there were otherwise an air gap at the ends of the elongated conducting elements (at the interface with the electrical leads).

Figure 3:
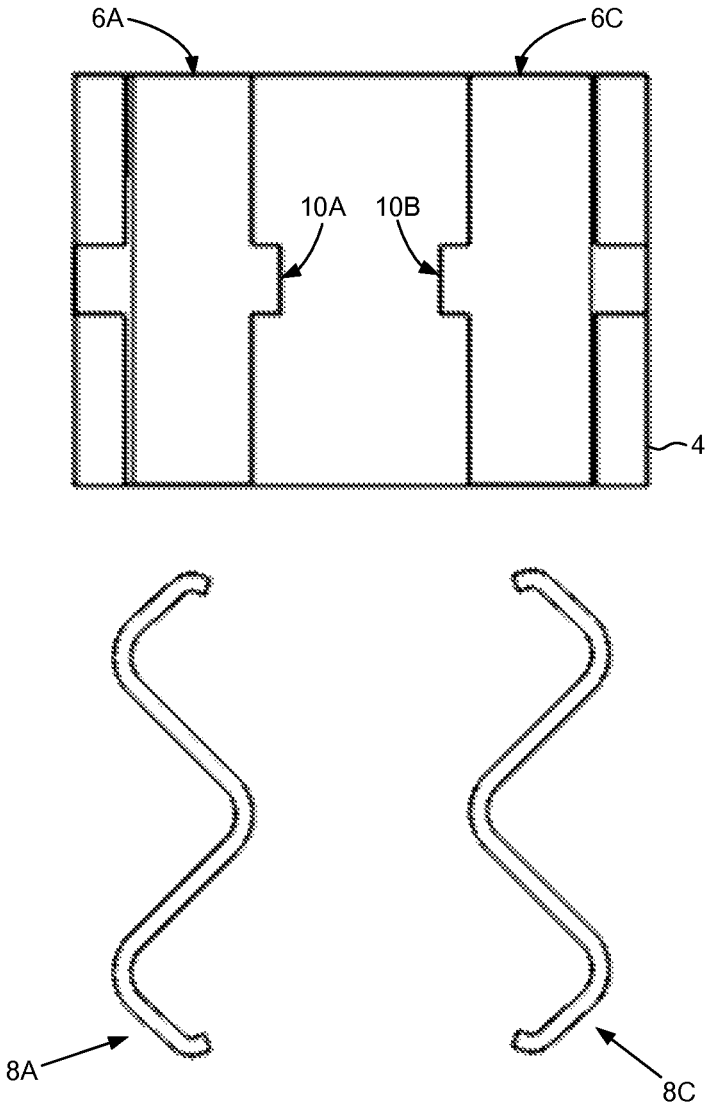
FIG. 3 shows an exploded, cross-sectional view of the solderless compression connector shown in FIG. 1A according to an embodiment of the present invention.

FIG. 3 shows an exploded, cross-sectional view of the housing 4 and elongated conducting elements 8A and 8C. The housing 4 (including the chambers 6A and 6C) may be manufactured using any suitable technique, and in one embodiment the housing 4 is manufactured using a suitable injection molding technique. For example, two rows of teeth may be closed and then plastic poured into an injection mold. When the plastic cools and solidifies, the rows of teeth are opened leaving the open chambers.

In the embodiment of FIG. 3, each elongated conducting element (e.g., 8A and 8C) comprises a spring feature operable to compress when the solderless compression connector is installed. In certain embodiments, the spring feature comprises a curve, and in the embodiment shown in FIG. 3, each elongated conducting element comprises a plurality of curves forming a W shape. When the compression connector is installed, the elongated conducting elements compress into each of their respective chambers as illustrated in FIG. 4B.

In one embodiment, each chamber comprises a retaining feature engaging a curve of the respective elongated conducting element in order to retain the elongated conducting element in the chamber prior to installing the solderless compression connector. FIG. 3 shows an embodiment wherein each chamber comprises a notch (e.g., 10A and 10B) for engaging the middle curve of the respective elongated conducting element as illustrated in FIG. 4A. The notch may be formed in any suitable manner, such as by inserting rods into an injection mold and then retracting the rods when the plastic cools, thereby leaving cavities in the sides of the housing 4 as illustrated in FIG. 1A. The retaining feature helps retain each elongated conducting element in their respective chambers, for example, while being inserted into a shipping container or during installation into a suitable electronic device, such as the disk drive shown in FIG. 5.

FIG. 4B illustrates an embodiment of the compression connector after being installed, wherein the elongated conducting elements are compressed such that at least ninety-eight percent of each elongated conducting element is housed within the respective chambers. Consequently, any air gap between the compression connector and the electrical leads of the electrical components is minimized, thereby helping to control the impedance as described above. FIG. 4B also illustrates an embodiment wherein each elongated conducting element comprises a first curved surface operable to engage the first electrical lead with a minor overhang at the first end, and a second curved surface operable to engage the second electrical lead with a minor overhang at the second end. The minor overhang at both ends of the elongated conducting elements helps control the impedance by minimizing the resulting capacitance that may be caused by a longer overhang.

The chambers formed in the housing may comprise any suitable geometry. In the embodiment of FIG. 4B, the chambers are formed by a middle rectangular shaped feature that extends along the length of the compression connector 2 in FIG. 1A. In this embodiment, the opposing chambers (e.g., 6A and 6C) are not isolated from one another. However, the spacing between adjacent chambers (e.g., 6A and 6B of FIG. 2) remains substantially constant by having a constant width of dielectric between the adjacent elongated conducting elements.

Figure 5:
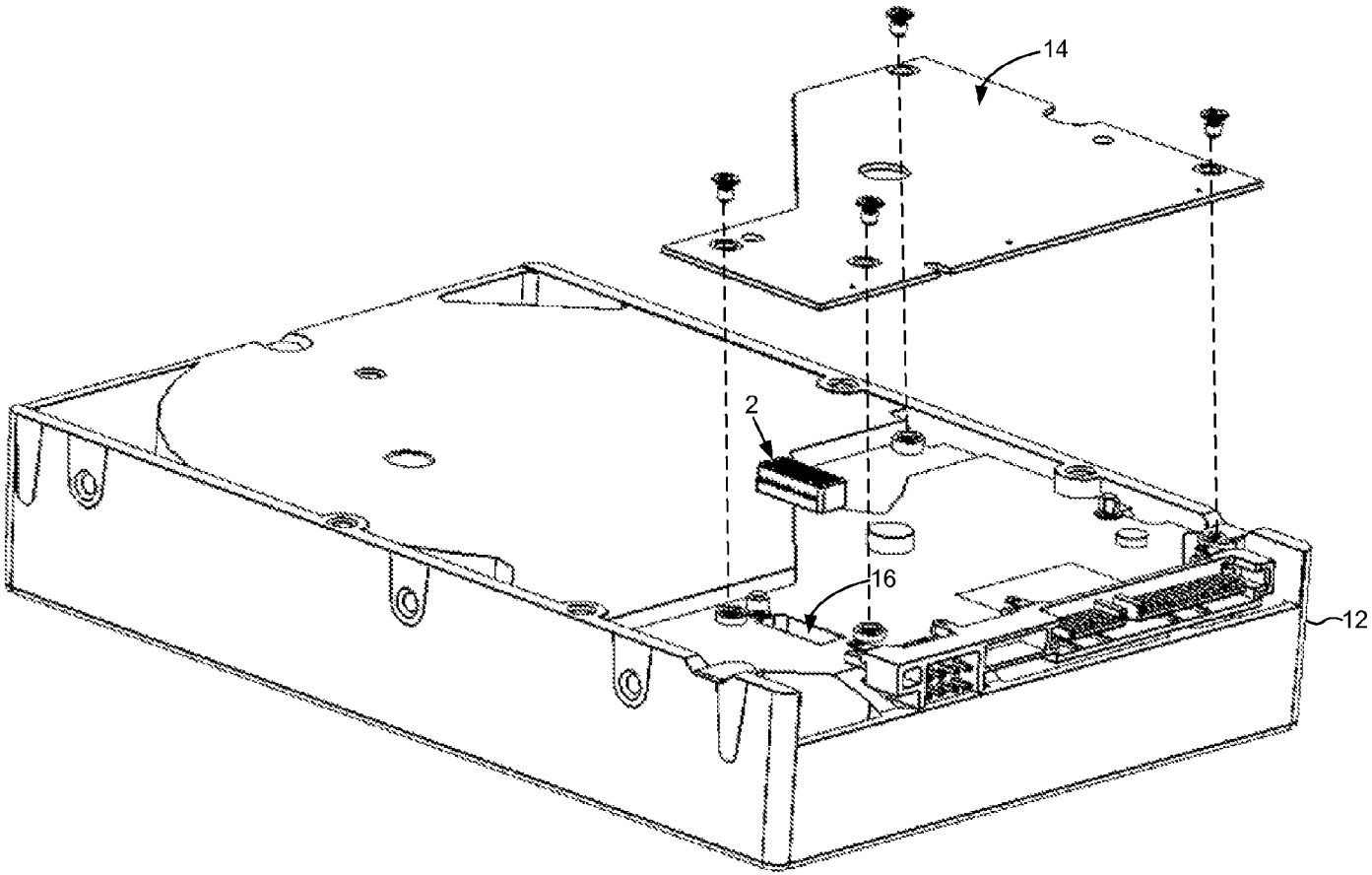
FIG. 5 shows a disk drive according to an embodiment of the present invention wherein the compression connector couples an electrical component inside a head disk assembly (HDA) to a printed circuit board (PCB).

FIG. 5 shows an exploded view of a disk drive according to an embodiment of the present invention comprising a head disk assembly (HDA) 12 comprising a head actuated over a disk and at least one electrical component such as a flex cable (not shown) for coupling the head to a PCB 14 using the solderless compression connector 2. During installation, the solderless compression connector 2 is installed into a chamber 16 of the HDA 12, wherein the bottom side of the solderless compression connector 2 engages electrical leads of the flex circuit (not shown). The PCB 14 is then inserted over the solderless compression connector 2 so that the electrical leads (not shown) of the PCB 14 engage the top side of the solderless compression connector 2. The PCB 14 is then fastened to the HDA (e.g., using screws as shown in FIG. 5) thereby compressing the elongated conducting elements of the solderless compression connector 2 into their respective chambers as described above.

In certain embodiments (such as illustrated in FIG. 5), the first end of the elongated conducting elements compress against the electrical leads of the first electrical component (e.g., flex circuit), thereby forming a first solderless connection, and the second end of the elongated conducting elements compress against the electrical leads of the second electrical component (e.g., PCB), thereby forming a second solderless connection.

What is claimed is:

1. A solderless compression connector operable to couple first and second electrical components, the solderless compression connector comprising:

a housing comprising a dielectric forming a plurality of chambers;

an elongated conducting element disposed in each chamber, wherein:

each elongated conducting element comprises a first end operable to engage a first electrical lead of the first electrical component, and a second end operable to engage a second electrical lead of the second electrical component;

each elongated conducting element comprises a substantially constant width along a length of the elongated conducting element;

each elongated conducting element comprises a substantially constant thickness;

a spacing between at least two of the elongated conducting elements is substantially constant; and after installing the solderless compression connector, the elongated conducting elements are housed substantially within the respective chambers.

2. The solderless compression connector as recited in claim 1, wherein at least ninety-eight percent of each elongated conducting element is housed within the respective chambers after installing the solderless compression connector.

3. The solderless compression connector as recited in claim 1, wherein each elongated conducting element comprises a spring feature operable to compress when the solderless compression connector is installed.

4. The solderless compression connector as recited in claim 3, wherein the spring feature comprises a curve.

5. The solderless compression connector as recited in claim 4, wherein the spring feature comprises a plurality of curves.

6. The solderless compression connector as recited in claim 5, wherein the spring feature comprises a W shape.

7. The solderless compression connector as recited in claim 5, wherein each elongated conducting element comprises:

a first curved surface operable to engage the first electrical lead with a minor overhang at the first end; and a second curved surface operable to engage the second electrical lead with a minor overhang at the second end.

8. The solderless compression connector as recited in claim 4, wherein each chamber comprises a retaining feature engaging the curve of the respective elongated conducting element in order to retain the elongated conducting element in the chamber prior to installing the solderless compression connector.

9. The solderless compression connector as recited in claim 3, wherein:

a first and second end of a first elongated conducting element extend outside the respective chamber prior to installing the solderless compression connector; and the first and second ends compress into the respective chamber when the solderless compression connector is installed.

10. The solderless compression connector as recited in claim 9, wherein when installing the solderless compression connector:

the first end of a first elongated conducting element compresses against the electrical lead of the first electrical component, thereby forming a first solderless connection; and the second end of the first elongated conducting element compresses against the electrical lead of the second electrical component, thereby forming a second solderless connection.

11. A disk drive comprising a head disk assembly (HDA) comprising a head actuated over a disk and at least one electrical component, and a solderless compression connector operable to couple a printed circuit board (PCB) to the electrical component, the solderless compression connector comprising:

a housing comprising a dielectric forming a plurality of chambers;

an elongated conducting element disposed in each chamber, wherein:

each elongated conducting element comprises a first end operable to engage a first electrical lead of the PCB, and a second end operable to engage a second electrical lead of the electrical component;

each elongated conducting element comprises a substantially constant width along a length of the elongated conducting element;

each elongated conducting element comprises a substantially constant thickness;

a spacing between at least two of the elongated conducting elements is substantially constant; and after installing the solderless compression connector, the elongated conducting elements are housed substantially within the respective chambers.

12. The disk drive as recited in claim 11, wherein at least ninety-eight percent of each elongated conducting element is housed within the respective chambers after installing the solderless compression connector.

13. The disk drive as recited in claim 11, wherein each elongated conducting element comprises a spring feature operable to compress when the solderless compression connector is installed.

14. The disk drive as recited in claim 13, wherein the spring feature comprises a curve.

15. The disk drive as recited in claim 14, wherein the spring feature comprises a plurality of curves.

16. The disk drive as recited in claim 15, wherein the spring feature comprises a W shape.

17. The disk drive as recited in claim 15, wherein each elongated conducting element comprises:

a first curved surface operable to engage the first electrical lead with a minor overhang at the first end; and a second curved surface operable to engage the second electrical lead with a minor overhang at the second end.

18. The disk drive as recited in claim 14, wherein each chamber comprises a retaining feature engaging the curve of the respective elongated conducting element in order to retain the elongated conducting element in the chamber prior to installing the solderless compression connector.

19. The disk drive as recited in claim 13, wherein:

a first and second end of a first elongated conducting element extend outside the respective chamber prior to installing the solderless compression connector; and the first and second ends compress into the respective chamber when the solderless compression connector is installed.

20. The disk drive as recited in claim 19, wherein when installing the solderless compression connector:

the first end of a first elongated conducting element compresses against the first electrical lead of the PCB, thereby forming a first solderless connection; and the second end of the first elongated conducting element compresses against the second electrical lead of the electrical component, thereby forming a second solderless connection.

21. The disk drive as recited in claim 11, wherein the HDA further comprises a chamber for housing the solderless compression connector.

* * * * *